US006722860B2

(12) United States Patent
Asano

(10) Patent No.: US 6,722,860 B2
(45) Date of Patent: Apr. 20, 2004

(54) OIL PUMP MOUNTING STRUCTURE

(75) Inventor: Masayuki Asano, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 36 days.

(21) Appl. No.: 10/145,037

(22) Filed: May 15, 2002

(65) Prior Publication Data

US 2002/0172606 A1 Nov. 21, 2002

(30) Foreign Application Priority Data

May 17, 2001 (JP) ..... P.2001-148444

(51) Int. Cl.[7] ..... F04B 17/05; F02F 7/00; F01M 1/00

(52) U.S. Cl. ..... 417/360; 417/364; 123/196 R; 123/198 C

(58) Field of Search ..... 417/360, 364; 123/196 R, 198 C

(56) References Cited

U.S. PATENT DOCUMENTS

| | | | | | |
|---|---|---|---|---|---|
| 2,737,341 | A | * | 3/1956 | Bitzer | 417/364 |
| 4,616,610 | A | * | 10/1986 | Ishida | 123/196 A |
| 4,997,409 | A | * | 3/1991 | Sonoda et al. | 474/101 |
| 5,743,230 | A | * | 4/1998 | Yamazaki et al. | 123/195 H |
| 5,901,679 | A | * | 5/1999 | Tanaka et al. | 123/195 C |
| 6,179,582 | B1 | * | 1/2001 | Matsunaga et al. | 417/360 |

FOREIGN PATENT DOCUMENTS

JP 6-45628 11/1994

* cited by examiner

*Primary Examiner*—Charles G. Freay
(74) *Attorney, Agent, or Firm*—Armstrong, Kratz, Quintos, Hanson & Brooks, LLP

(57) ABSTRACT

In mounting a crankshaft direct-driven oil pump to an engine, the oil pump is mounted to a cylinder block which supports a crankshaft, as well as an integral bearing cap in which bearing cap portions are connected to each other by beam portions.

7 Claims, 5 Drawing Sheets

OIL PUMP MOUNTING STRUCTURE

BACKGROUND OF THE INVENTION

1. Field of the Invention

The present invention relates to an oil pump mounting structure for mounting an oil pump to an engine, and more particularly to an oil pump mounting structure for mounting on an engine an oil pump adapted to be driven by the rotational force of a crankshaft.

2. Description of the Related Art

Oil is supplied to various places of an engine by an oil pump. Oil exhibits lubricating function, cooling function, rust preventing function and the like when it is supplied to the various places of the engine. For example, when the oil is delivered to rotating and sliding portions of the engine, the oil functions to lubricate those portions and reduces the frictional resistance thereat to thereby enable the engine to operate smoothly. In addition, when it is delivered to portions of the engine which are liable to be heated or rust, the oil functions to cool the portions or protect them against rust to thereby allow the engine to operate smoothly.

After having functioned to lubricate and cool those portions of the engine, the oil so delivered then drops in the form of droplets or flows down along walls of the portions and is finally collected in an oil pan which is an oil reservoir provided at a lower portion of the engine. Then, in an engine using a wet sump, the oil so collected in the oil pan is designed to be drawn up by the oil pump to be supplied again to the various portions of the engine.

Incidentally, conventionally known as an oil pump which plays such an important role is a crankshaft-driven type oil pump which is designed to connect to the crankshaft of an engine to be driven. This type of oil pump is designed in general to be fixed to the cylinder block with bolts which function as oil pump mounting portions. For example, JP-B-6-45628U discloses an "engine with a balancer shaft" in which a pump housing (an oil pump) is fixed to the cylinder block with bolts.

FIG. 5 is a view showing a conventional mounting structure for mounting this type of crankshaft-driven oil pump to an engine. In FIG. 5, denoted by reference numerals 102, 107, 110 and 111 and a reference character B are, respectively, a cylinder block, a crankshaft, a bearing cap, an oil pump and bolts. The oil pump 111 contoured by thicker solid lines in FIG. 5 is a trochoidal oil pump which has an inner rotor and an outer rotor, both not shown, which are profiled by a trochoidal curve and is adapted to draw oil through a time lag in rotation between the two rotors and supply it under pressure to required portions of the engine. The oil pump 111 is fixed to the cylinder block 102 with the bolts B. In addition, the oil pump 111 is designed such that the inner rotor is caused to rotate by virtue of rotational force obtained from the crankshaft 107 which is passed into the inner rotor.

In the mounting structure for the oil pump shown in FIG. 5, however, the oil pump 111 is fixed only to mounting portions on the cylinder block 102. On the other hand, as shown in FIG. 5, the oil pump 111 is constructed such that it extends (protrudes) downwardly of the cylinder block in order to draw oil from the oil pan (not shown). In this construction, the oil pump 111 is mounted only at an upper portion thereof to the cylinder block 102, which reduces the mounting rigidity and deteriorates the mounting balance, and thus the construction is not preferable as the mounting structure of the oil pump 111. In addition, in order to increase the mounting rigidity of the oil pump 111, as shown in FIG. 5, a construction is required in which the cylinder block 102 extends below the crankshaft 107, and this results in an increase in the overall weight of the engine or a reduction in degree of freedom in designing engines.

SUMMARY OF THE INVENTION

Then, a primary object of the invention is to provide a mounting structure for an oil pump which can solve the problems to thereby increase the mounting rigidity, as well as the mounting stability.

In view of the problems the inventors devoted themselves to study and paid their attention to an idea that the oil pump is mounted not only to the cylinder block but also a bearing gap, thus the invention having been completed.

With a view to attaining the object, according to a first aspect of the invention, there is provided an oil pump mounting structure for mounting a crankshaft-driven type oil pump to an engine, characterized in that oil pump mounting portions where the oil pump is mounted are provided on both a cylinder block and a bearing cap which support a crankshaft together with each other, whereby the oil pump is mounted on the engine via the oil pump mounting portions.

According to the construction, the oil pump mounting portions where the oil pump is mounted are provided on the bearing gap as well, whereby the oil pump is mounted to the engine both at the cylinder block and the bearing cap. Thus, the mounting rigidity and mounting stability of the oil pump to the engine can be increased. Note that in an embodiment which will be described later, mounting seats (bolt holes) which function as oil pump mounting portions are provided in the cylinder block and the bearing cap, so that the oil pump can be mounted to both the cylinder block and the bearing cap with bolts.

According to a second aspect of the invention, there is provided an oil pump mounting structure as set forth in the first aspect of the invention, wherein the oil pump mounting portions which are provided on the bearing cap are disposed between center lines of a pair of bolt holes through which bolts are allowed to pass to mount the bearing cap to the cylinder block on both sides of the crankshaft as viewed from the front of the crankshaft in an axial direction thereof.

According to the construction, the oil pump mounting portions are provided at portions of the bearing gap which have a certain strength. Consequently, the mounting rigidity and mounting stability of the oil pump to the engine can be increased. In addition, the necessity of enlarging the oil pump and the bearing cap can be suppressed. Note that the word, front, which is used in the claim as stating, "as viewed from the front of . . . " denotes a direction which is illustrated in FIG. 4B which depicts the embodiment of the invention which will be described later.

According to a third aspect of the invention, there is provided an oil pump mounting structure as set forth in the first or second aspect of the invention, wherein the bearing cap on which the oil pump mounting portions are provided is connected to an adjacent bearing cap by a connecting wall.

According to the construction of the third aspect of the invention, since the bearing cap on which the oil pump mounting portions are provided is connected to the adjacent bearing cap, the rigidity of the bearing gap can be increased. Thus, the mounting rigidity of the oil pump which is mounted to the bearing cap can also be increased. Note that rigidity can further be increased in the event that all the bearing caps are constructed to be connected to one another as described in the embodiment of the invention which will be described later.

According to a fourth aspect of the invention, there is provided an oil pump mounting structure as set forth in the third aspect of the invention, wherein the oil pump mounting portions that are provided on the bearing cap are provided at a portion of the bearing cap where the connecting wall is connected to the bearing cap.

The portion of the bearing cap where the connecting wall is connected to the bearing cap is a portion having a high rigidity. According to the construction, since the oil pump mounting portions are provided at the highly rigid portion of the bearing cap where the connecting wall is connected thereto, the mounting rigidity of the oil pump which is mounted to the engine via the oil pump mounting portions can be inevitably increased.

In addition, when looking at the respective constructions of the invention from a different point of view, the mounting rigidity and mounting stability of the bearing cap to the cylinder block can be increased by mounting the oil pump to both the cylinder block and the bearing cap. In this case, the oil pump plays a role of reinforcement in mounting the bearing cap to the cylinder block.

DETAILED DESCRIPTION OF THE PREFERRED EMBODIMENTS

Referring to the appended drawings, an embodiment of the invention will be described below.

Firstly, referring to FIGS. 1 and 2, the construction of an engine will be described.

Figure 1:
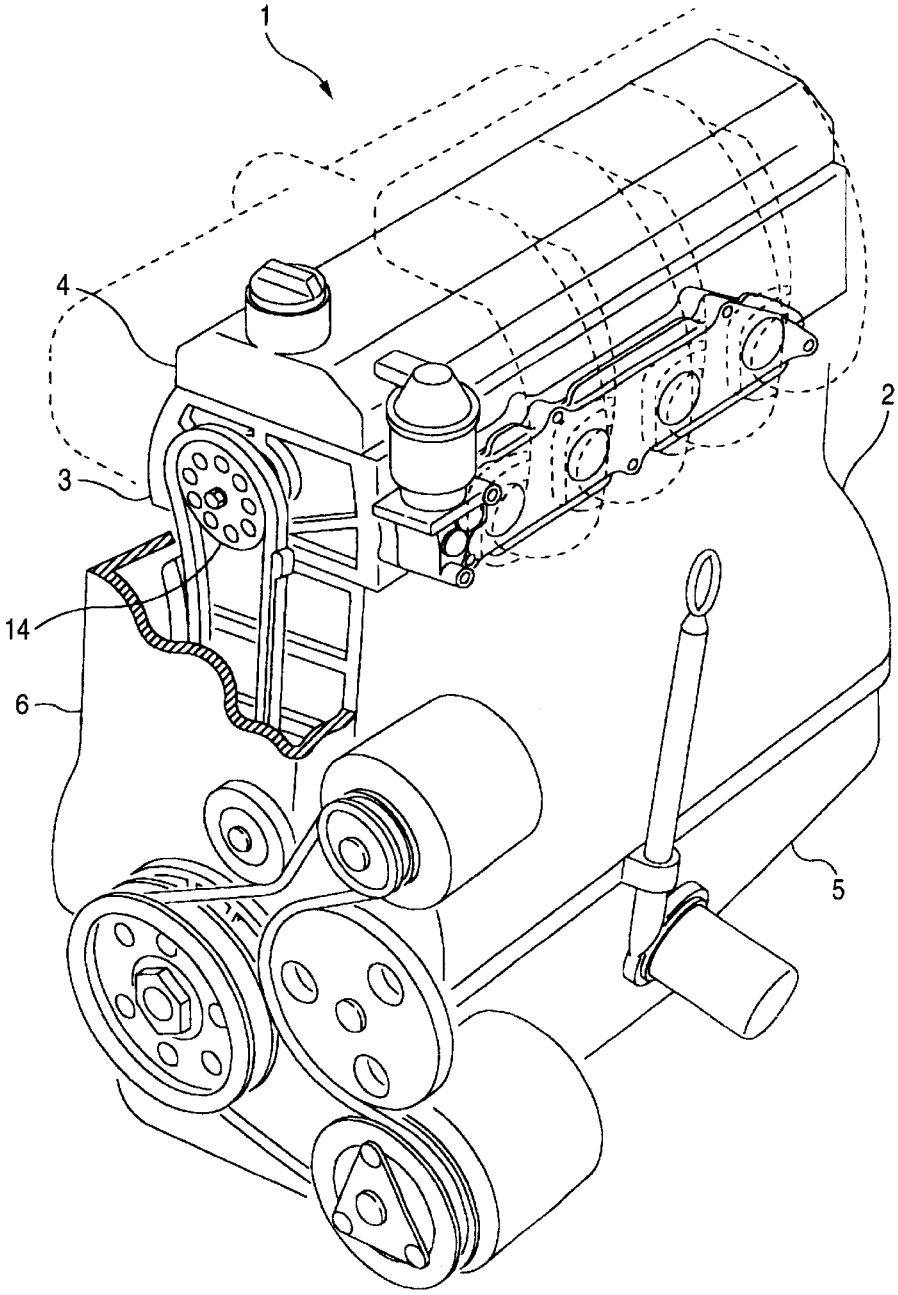
FIG. 1 is a perspective view of an engine to which an oil pump mounting structure according to an embodiment of the invention is applied.

An oil pump mounting structure according to the invention is applied to, for example, an automotive engine 1 as shown in FIG. 1. This engine 1 is an SOHC (Single Over Head Camshaft), in-line four-cylinder engine, in which a cylinder head 3 and a cylinder head cover 4 are joined sequentially onto a top of a cylinder block 2 in that order, whereas an oil pan 5 is joined to a bottom of the cylinder block 2. Then, a chain case 6 is mounted at an end of the engine in such a manner as to straddle over the cylinder block 2 and the cylinder head 3.

Figure 2:
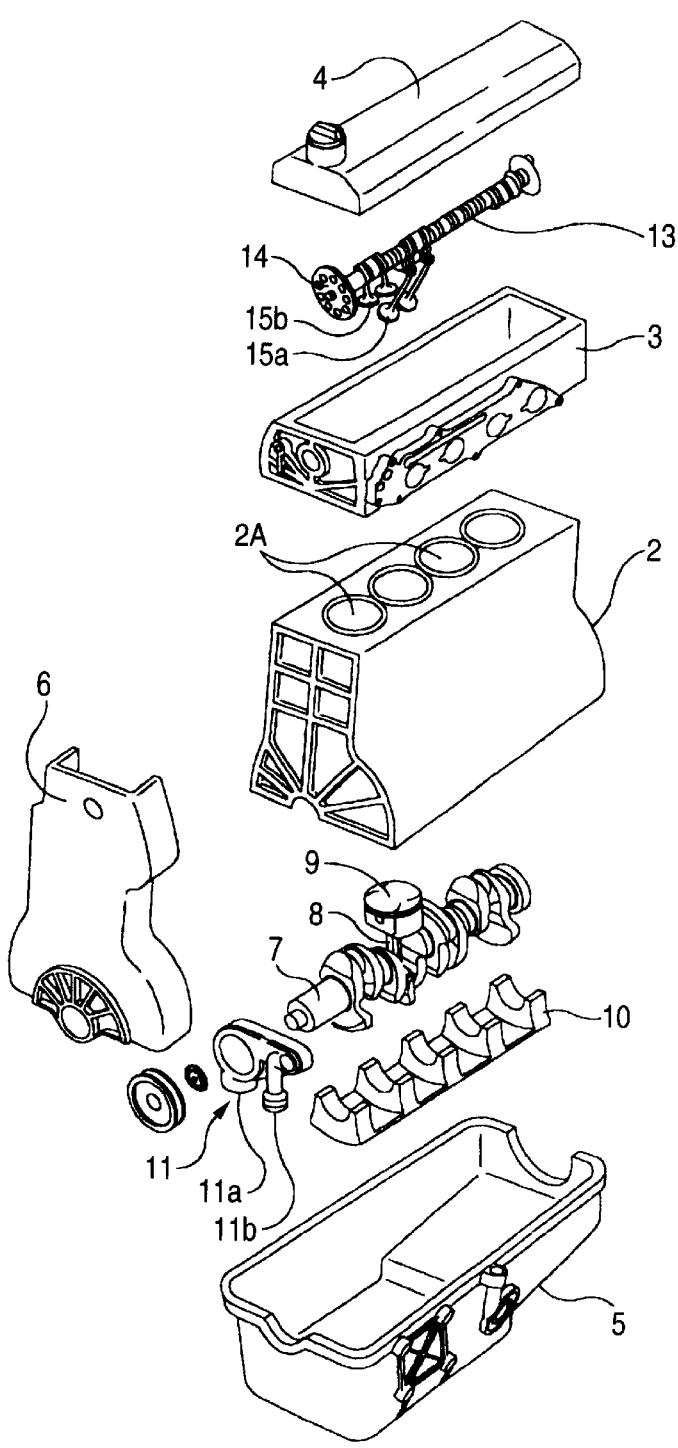
FIG. 2 is an exploded perspective view of the engine shown in FIG. 1.

As shown in FIG. 2, the cylinder block 2 has four cylinder bores 2A, 2A . . . which are arranged in a line, and a piston 9 which is connected to a crankshaft 7 via a connecting rod 8 is slidably and fittingly inserted in each cylinder bore 2A. In addition, the crankshaft 7 is rotatably assembled to a lower portion of the cylinder block 2 by an integral bearing cap 10 in which five individual bearing cap portions are integrally connected to each other. Furthermore, a trochoidal oil pump 11 is assembled to an end of the crankshaft 7 which protrudes from the cylinder block 2. To be specific, the crankshaft 7 is inserted into the interior of an inner rotor, not shown (a crankshaft direct-driven type oil pump). Then, the oil pump 11 is designed to supply oil reserved in the oil pan 5 to various portions of the engine 1 using the rotational force of the crankshaft 7 which is obtained directly therefrom. Note that reference numeral 11*a* denotes an oil inlet to which a strainer, not shown, is connected. In addition, reference numeral 11*b* denotes a relief hole from which oil is returned to the oil pan 5 when the discharge pressure of the oil pump 11 reaches or exceeds a predetermined value, whereby the discharge pressure is controlled such that it remains below the predetermined value.

Incidentally, the crankshaft direct-driven oil pump may include an oil pump which is connected to the crankshaft via a gear or the like provided on the crankshaft so as to be driven by the crankshaft without involving a chain or belt. Note that with the crankshaft direct-driven oil pump the engine can be made smaller in size.

In addition, a camshaft 13 is rotatably supported and accommodated in a space above the cylinder head 3 which is covered with the cylinder head cover 4. An end (an end closer to the viewer as viewed in FIG. 2) of the camshaft 13 protrudes from an end of the cylinder head 3 (an end closer to the viewer as viewed in FIG. 2), and a cam sprocket 14 is fixed to the end of the camshaft 13, whereby the camshaft 13 is designed to rotate when it receives power from the crankshaft 7. Note that reference numeral 15 (15*a*, 15*b*) denotes intake and exhaust valves for supplying fuel to and discharging combustion gas from a combustion chamber, not shown, which is constituted by the cylinder block 2, the cylinder head 3 and the piston 9.

Figure 3:
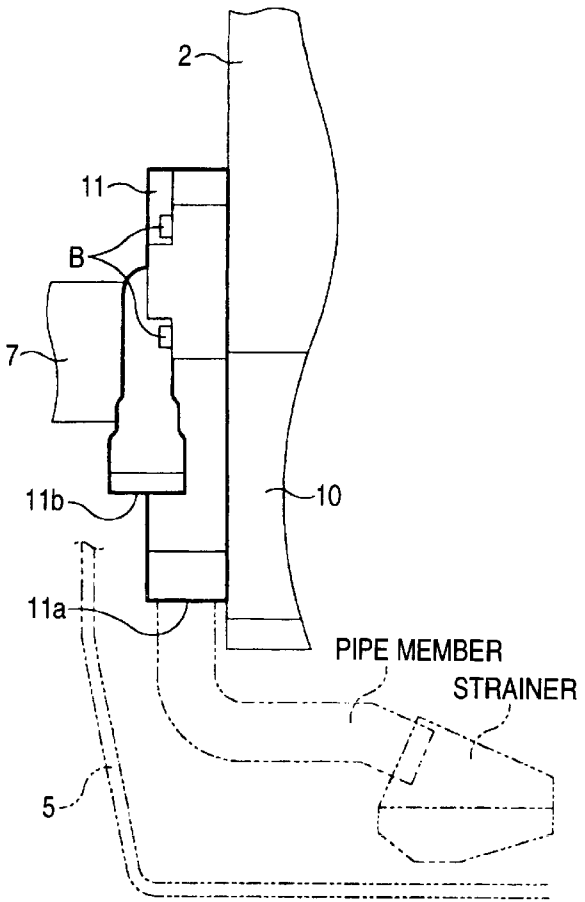
FIG. 3A is a front view of the oil pump mounting structure for mounting an oil pump to an engine according to the embodiment of the invention.
FIG. 3B is a side view of the oil pump mounting structure for mounting an oil pump to an engine according to the embodiment of the invention.
Figure 3:
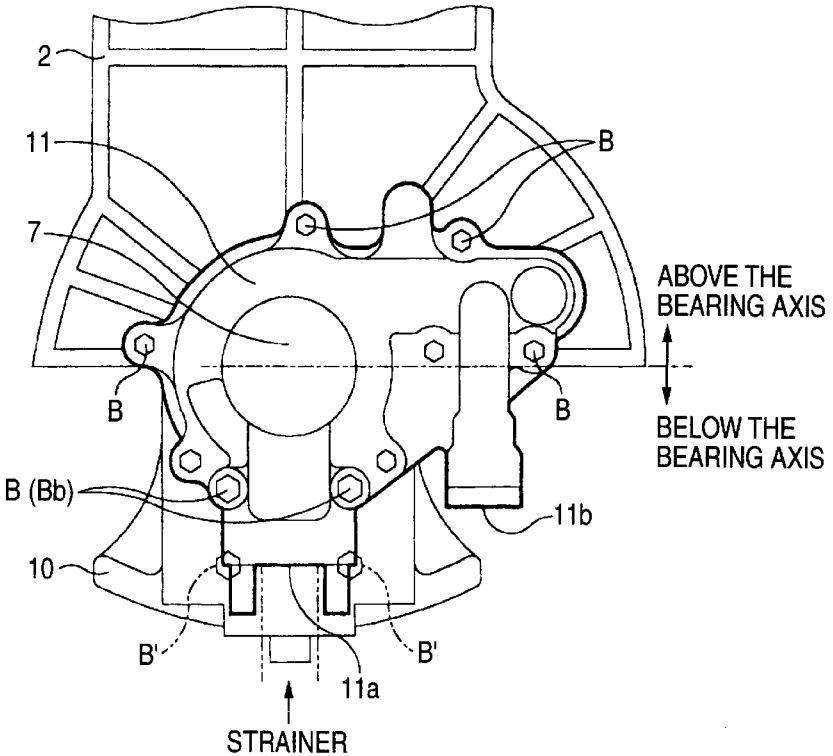
Figure 4:
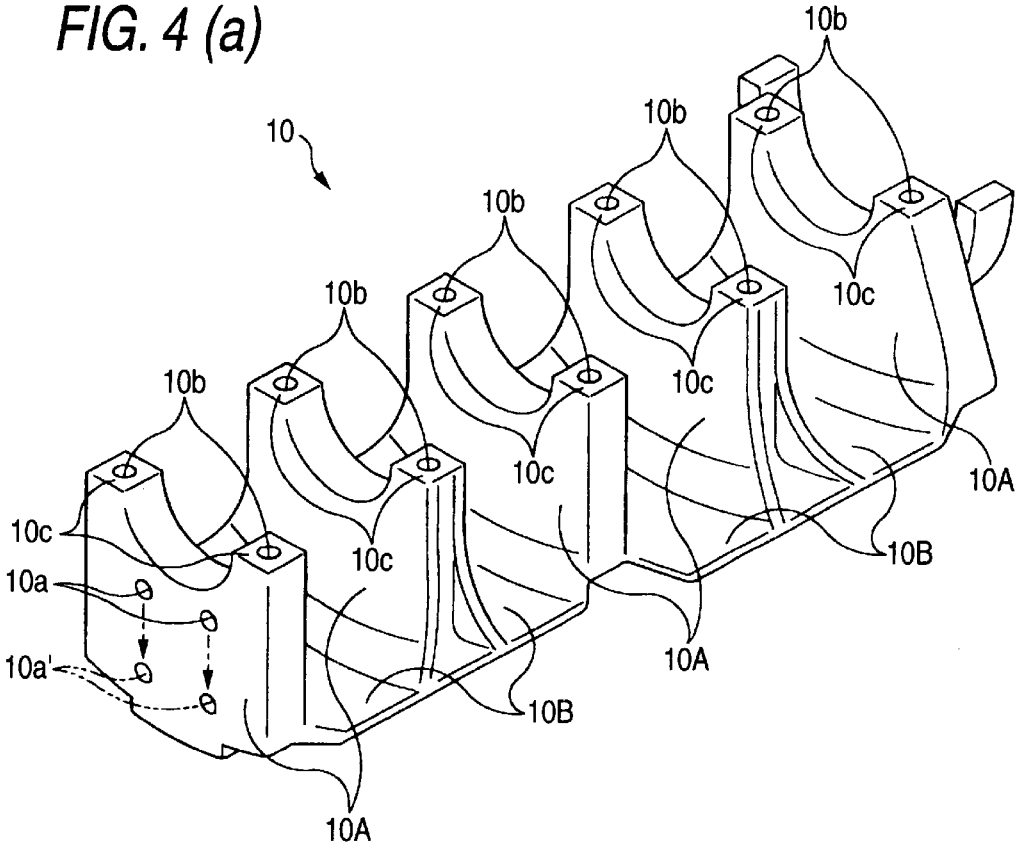
FIG. 4A is a front view of an integral bearing cap shown in FIGS. 3A and 3B.
FIG. 4B is a perspective view of the integral bearing cap shown in FIGS. 3A and 3B.
Figure 4:
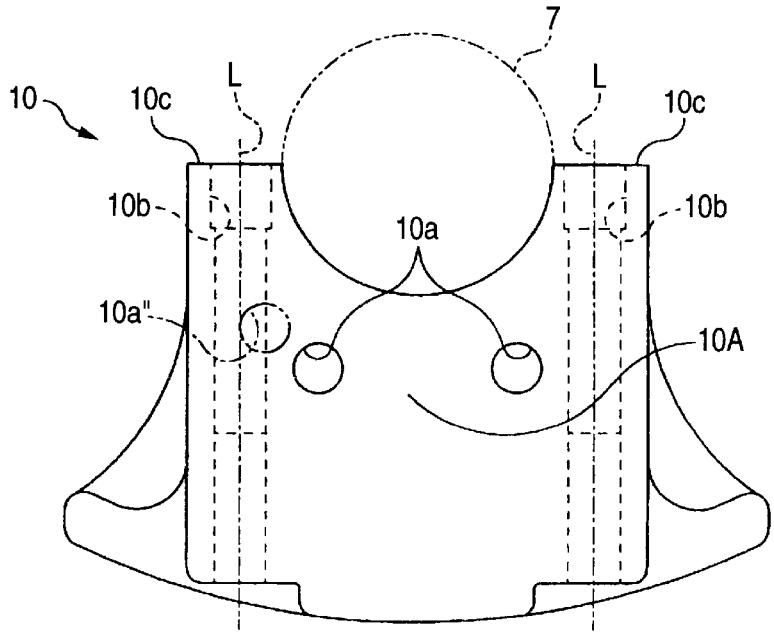

Next, referring to FIGS. 3 and 4, an oil pump mounting structure will be described.

Figure 5:
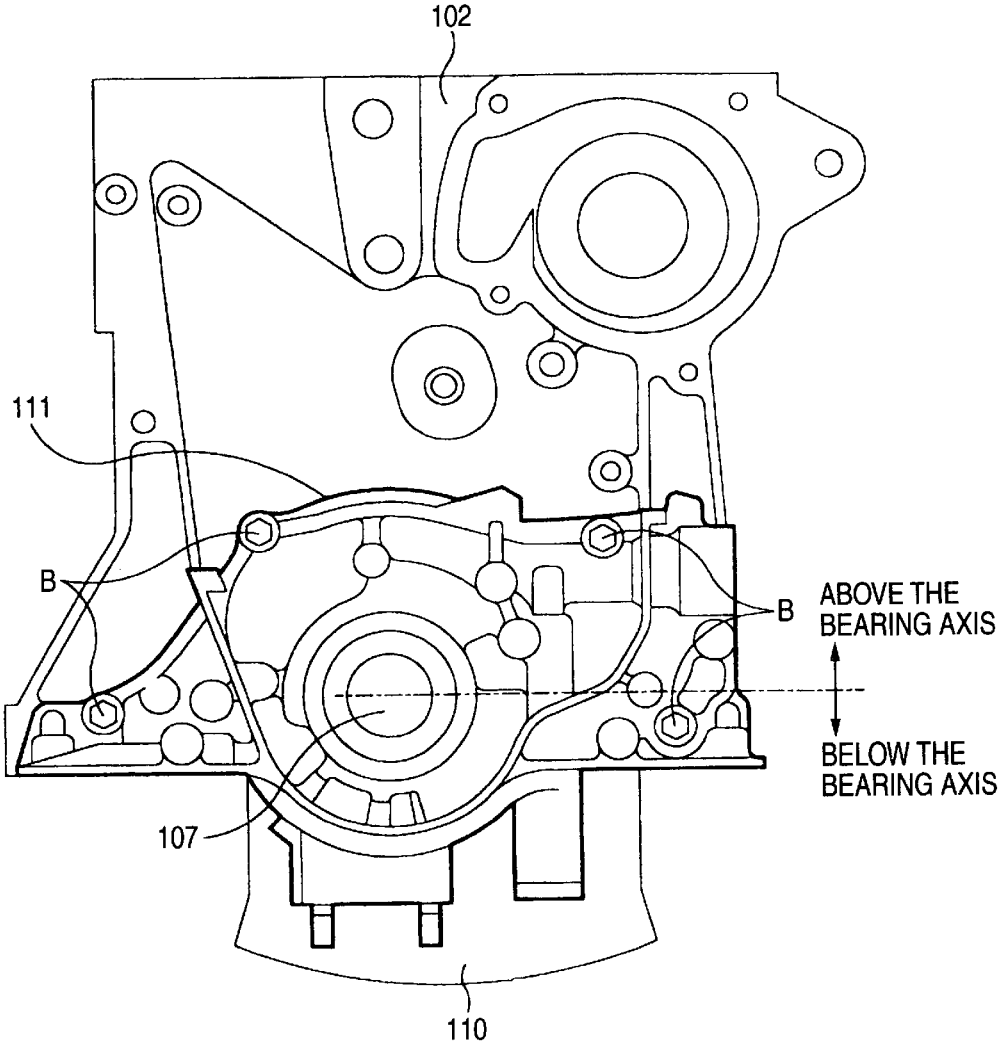
FIG. 5 PRIOR ART
FIG. 5 is a view showing an oil pump mounting structure for mounting an oil pump to an engine according to a conventional example.

In FIG. 3A, the oil pump 11 is contoured with thicker solid lines, and as shown in FIGS. 3A and 3B, the oil pump 11 is fixed to both the cylinder block 2 and the integral bearing cap 10 with bolts B(Bb) in a vertically well-balanced state about a bearing axis 7. Consequently, being different from the conventional example shown in FIG. 5 in which the oil pump 111 is fixed to the cylinder block 102 only at the upper side thereof, the mounting rigidity of the oil pump 11 to the engine 1 (the cylinder block 2 and the integral bearing cap 10) is increased. In addition, the mounting stability of the oil pump 11 to the engine 1 is also increased. Furthermore, being different from the conventional example shown in FIG. 5, since there exists no portion which is located below the bearing axis 7 of the cylinder block 2, the weight of the cylinder block 2 (and hence the weight of the engine) can be reduced by such an extent.

As shown by the perspective view in FIG. 4A, the integral bearing cap 10 on which the oil pump 11 is mounted has a comb-like construction (a comb-type construction) in which five bearing cap portions 10A, 10A . . . are connected to each other by four beam portions (connecting walls) 10B, 10B . . . in such a manner that teeth of a comb are connected to each other by integrating the five bearing cap portions with the four beam portions (for example, casting them into an integral body). In addition, a semi-circularly depressed bearing portion is formed in an upper portion of each bearing cap portion 10A which corresponds to a tooth of the comb-type construction, and a bearing, not shown, which is to be mounted in this bearing portion is designed to contact the crankshaft 7. Additionally, provided on upper surfaces located on sides of the bearing cap portion 10A (i.e., locations of the bearing cap portion 10A except for the semi-circularly depressed portion thereof) are connecting surfaces 10*c* where the integral bearing cap 10 is connected to the cylinder block 2. Furthermore, bolt pass-through holes 10*b* are provided in each bearing cap portion 10A in such a manner as to extend through the bearing cap portion 10A from the bottom to the top thereof, whereby the integral bearing cap 10 is designed to be connected and fixed to the cylinder block 2 via these bolt pass-through holes 10*b*.

Moreover, two bolt holes 10*a* (mounting seats), which function as oil pump mounting portions, are provided in the bearing cap portion 10A of the integral bearing cap 10 shown in FIG. 4A which is the closest to the viewer of the figure, so that the oil pump 11 is mounted and fixed to not only the cylinder block 2 but also the integral bearing cap 10 with bolts Bb. Note that the bolt holes 10*a* constitute the oil pump mounting portions which are set forth in the claim of this specification. In addition, as shown in FIG. 4B, the bolt holes 10*a*, 10*a* are disposed between (inside) respective center lines L, L of the pair of bolt pass-through holes 10*b*, 10*b* which are formed to mount the bearing cap portions 10A to the cylinder block 2 at positions on both sides of the crankshaft 7 as viewed from the front in the direction of the crankshaft 7. This serves not only to increase the mounting rigidity and mounting stability of the oil pump 11 but also to suppress the enlargement of the oil pump 11, as well as the integral bearing cap 10 (10A). Additionally, since the bolt holes 10*a* are formed between the pair of bolt pass-through holes 10*b*, 10*b*, the construction contributes to further miniaturization of the oil pump 11 and the integral bearing cap 10 (10A). Note that even in a case where a bolt hole denoted by reference numeral 10*a*" is formed in a position indicated by an imaginary line in FIG. 4B, it can be said that the bolt hole 10*a*" is still located between the center lines L, L.

Incidentally, although a description thereof has been omitted, a plurality of holes are also formed in the cylinder block 2 at corresponding positions in which the bolts B are received such that the oil pump 11 is mounted to the cylinder block 2.

Since the bearing cap portions 10A are connected to each other by the beam portions 10B in the integral bearing cap 10 used in the embodiment, the rigidity of the bearing cap is increased, and therefore it is natural that the mounting rigidity of the oil pump 11 is increased accordingly which is mounted to the highly rigid integral bearing cap 10. In addition, the mounting stability of the oil pump 11 so mounted is also increased. Furthermore, the crankshaft 7 can securely be supported.

Next, the function of the oil pump 11 will be described which is mounted to the cylinder block 2 and the bearing cap 10 using the oil pump mounting structure according to the embodiment of the invention (refer to FIGS. 1 to 4 appropriately).

When the engine 1 is started, the reciprocating motion of the piston 9 is converted into the rotating motion of the crankshaft 7 by a crank mechanism constituted by constituent components including the crankshaft 7, the connecting rod 8 and the piston 9.

An inner rotor of the oil pump 11 is made to rotate by virtue of the rotating motion of the crankshaft 7. Then, an outer rotor of the oil pump 11 is made to rotate in conjunction of the rotation of the inner rotor. Drawing force and compressive force are generated in the oil pump 11 due to a time lag in the rotating motions of the two rotors, whereby oil is drawn from the oil pan 5 through a strainer and a pipe member which are both indicated by imaginary lines in FIG. 3B for supply to various portions of the engine 1 under pressure. As this occurs, the oil pump 11 is mounted to the cylinder block 2, as well as the integral bearing cap 10 with the bolts B(Bb). Due to this, the mounting rigidity of the oil pump 11 is increased. In addition, the mounting stability thereof is also increased. Consequently, vibrations generated by the oil pump 11 are reduced remarkably when compared with the conventional example.

As shown in FIGS. 4A and 4B, in the embodiment, the bolt holes 10*a* for mounting the oil pump 11 to the integral bearing cap 10 are formed in the front-most bearing cap portion 10A at the height of a substantially central portion (or in a central portion) thereof. However, in the event that the bolt holes 10*a* are formed at positions indicated by imaginary lines and reference numeral 10*a*' (or in a lower portion) in FIG. 4B, in other words, in the event that the bolt holes 10*a* are formed in a portion of the bearing cap portion 10A where the beam portion 10B which corresponds to the root of a tooth of a comb is connected to the bearing cap portion 10A, the mounting rigidity of the oil pump 11 is further increased, which is preferable (refer to claim 4). This is because the portion of the bearing cap portion 10A where the beam portion 10B is connected to the bearing cap portion 10A is higher in rigidity than the central portion thereof. Additionally, in the event that the oil pump 11 is designed to be mounted to the bearing cap portion 10A at both the central portion (i.e., the positions indicated by reference numeral 10*a* in FIG. 4A) and the lower portion (i.e., the positions indicated by 10*a*' in the same figure), the mounting rigidity of the oil pump 11 is increased further. In addition, the supporting rigidity of the strainer indicated by the imaginary lines in FIG. 3B (the strainer connected to the oil pump 11 via the pipe member) can be increased. In this connection, the bolts B (Bb) in FIG. 3B are fastened in the bolt holes 10*a* in FIG. 4A, and bolts B' indicated by imaginary lines in FIG. 3B are fastened in the bolt holes 10*a*' indicated by the imaginary lines in FIG. 4A.

Note that the invention maybe modified variously without being limited to the embodiment of the invention which has been described heretofore.

For example, while the SOHC engine is described as being used as the engine 1, it is needless to say that the invention can be applied to a DOHC (Double Over Head Camshaft) engine. In addition, while the in-line four-cylinder engine is described as being used as the engine 1, it goes without saying that the invention can be applied to any type of engine including a single-cylinder engine, a two-cylinder engine, a six-cylinder engine and a vee eight-cylinder engine. Furthermore, while the comb-type construction in which the bearing cap portions 10A are connected to each other by the beam portions 10B is described as being used as the integral bearing cap 10, the bearing cap portions 10A do not necessarily have to be connected to each other. Additionally, while the trochoidal oil pump is described as being used as the oil pump 11, the invention can be applied to a gear type pump including an internal gear pump provided that the gear pump is driven by the crankshaft. In addition, while the dry sump is described as being used as the oil pan, it goes without saying that the invention can be applied to a wet sump.

Moreover, while the invention has been described as being made mainly to increase the mounting rigidity of the oil pump 11 to the engine 1, in the event that the housing of the oil pump 11 has a certain rigidity, the mounting rigidity of the integral bearing cap 10 (10A) to the engine 1 (the cylinder block 2) can be increased by the oil pump 11. According to the construction, the crankshaft 7 can be supported such that it rotates smoothly.

Thus, according to the first aspect of the invention, since the oil pump is mounted to the cylinder block, as well as the bearing cap, the mounting rigidity of the oil pump to the engine can be increased. In addition, the mounting stability of the oil pump can also be increased. Furthermore, the weight of the engine can also be reduced.

According to the second aspect of the invention, since the oil pump is mounted to the portion of the bearing cap which has a certain strength (or the portion thereof which has a high rigidity), the mounting rigidity and mounting stability of the engine can further be increased.

According to the third aspect of the invention, since the bearing cap on which the oil pump mounting portions are provided is connected to the adjacent bearing cap by the connecting wall, the rigidity of the bearing cap is increased, and naturally the mounting rigidity and mounting stability of the oil pump which is mounted to this bearing cap can be increased further.

According to the fourth aspect of the invention, since the oil pump is mounted to the bearing cap at the portion thereof which has the higher rigidity (the portion thereof which has a certain strength), the mounting rigidity and mounting stability of the oil pump to the engine can be increased.

What is claimed is:

1. An oil pump mounting structure for mounting an oil pump to an engine, comprising:

a crankshaft;

an oil pump driven by said crankshaft; and a cylinder block and a bearing cap which support said crankshaft together with each other, said cylinder block and said bearing cap respectively including oil pump mounting portions where said oil pump is mounted, whereby said oil pump is mounted on said engine via said oil pump mounting portions;

wherein said bearing cap having said oil pump mounting portion is connected to an adjacent bearing cap by a connecting wall; and wherein said oil pump mounting portion that is provided on said bearing cap is formed at a portion of said bearing cap where said connecting wall is connected to said bearing cap.

2. The oil pump mounting structure as set forth in claim 1, wherein said oil pump mounting portion which is provided on said bearing cap is disposed between center lines of a pair of bolt holes through which bolts pass to mount said bearing cap to said cylinder block on both sides with respect to said crankshaft as viewed from the front of said crankshaft in an axial direction thereof.

3. The oil pump mounting structure as set forth in claim 2, wherein said bearing cap having said oil pump mounting portion is connected to an adjacent bearing cap by a connecting wall.

4. The oil pump mounting structure as set forth in claim 3, wherein said oil pump mounting portion that is provided on said bearing cap is formed at a portion of said bearing cap where said connecting wall is connected to said bearing cap.

5. The oil pump mounting structure as set forth in claim 1, wherein a lower surface of said cylinder block is connected to said bearing cap without projecting below said crankshaft.

6. The oil pump mounting structure as set forth in claim 5, wherein the lower surface of said cylinder block connecting with said bearing cap is positioned at the substantially same height as a center axis of said crankshaft.

7. The oil pump mounting structure as set forth in claim 2, wherein said oil pump mounting portions are provided between center lines of bolts and at a plurality of portions, and thereby the oil pump is stably mounted at a portion which has a high rigidity.

* * * * *